United States Patent [19]

Wilks

[11] Patent Number: 4,817,567

[45] Date of Patent: Apr. 4, 1989

[54] ROTARY PISTON ENGINE

[76] Inventor: Ronald C. Wilks, 415 Cora St., Apt. 202, Arlington, Tex. 76011

[21] Appl. No.: 139,469

[22] Filed: Dec. 30, 1987

[51] Int. Cl.[4] ..... F02B 53/00

[52] U.S. Cl. ..... 123/231; 418/221

[58] Field of Search ..... 123/228, 231; 418/221

[56] References Cited

U.S. PATENT DOCUMENTS

| | | | |
|---|---|---|---|
| 939,751 | 11/1909 | Schulz . | |
| 1,113,234 | 10/1914 | Morgan . | |
| 1,309,767 | 7/1919 | Morgan . | |
| 1,320,182 | 10/1919 | Smith et al. . | |
| 1,427,053 | 8/1922 | Bidwell | 123/231 |
| 1,581,148 | 4/1926 | Williams . | |
| 1,799,527 | 4/1931 | Plato . | |
| 2,158,532 | 5/1939 | Bullen . | |
| 2,180,352 | 11/1939 | Fahrney . | |
| 2,353,446 | 7/1944 | Davidson | 123/228 |
| 2,402,257 | 6/1946 | Rich . | |
| 3,114,354 | 12/1963 | Simon . | |
| 3,478,727 | 11/1969 | Marcoux . | |
| 3,609,071 | 9/1971 | Brown | 418/221 |
| 4,311,121 | 1/1982 | Hartsell | 123/228 |
| 4,414,938 | 11/1983 | Umeda | 123/229 |
| 4,507,067 | 3/1985 | Hansen | 418/221 X |
| 4,548,171 | 10/1985 | Larson | 123/230 |

FOREIGN PATENT DOCUMENTS 2725036 12/1978 Fed. Rep. of Germany ..... 123/228

*Primary Examiner*—Michael Koczo

*Attorney, Agent, or Firm*—Dennis T. Griggs

[57] ABSTRACT

A rotary piston engine having a pear-shaped piston with convex sides is mounted for rotation within a housing whose internal cross-section presents a symmetrical oval shape which is slightly constricted in the middle. The annulus between the piston and the housing is subdivided into intake, compression, expansion and exhaust chambers by four spring loaded vanes. A compression vane and a counter-piston vane are mounted on opposite sides of an external combustion chamber and their movements are coordinated to seal the combustion chamber with respect to the exhaust chamber and the intake chamber during compression and combustion. An engine separation vane, mounted for reciprocal movement and sliding engagement against the piston, separates the intake and exhaust chambers. A vane carried by the piston bears against the housing bore and subdivides each chamber in turn as the piston rotates. Combustion of compressed fuel/air mixture is accomplished while the external combustion chamber is isolated with respect to the intake and expansion chambers. The engine develops one power stroke per revolution, as compared with one power stroke on every other revolution in a conventional reciprocating piston engine.

7 Claims, 6 Drawing Sheets

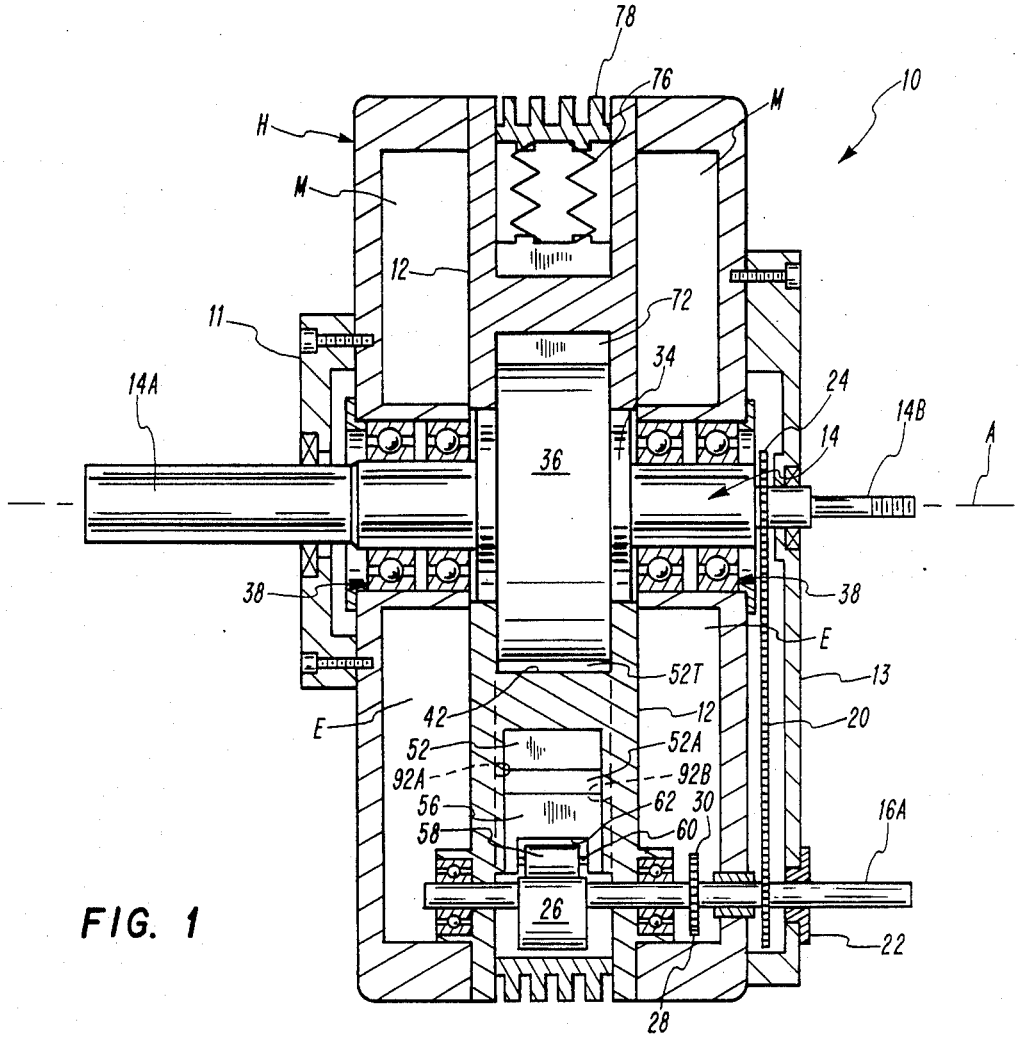
FIG. 1
FIG. 2
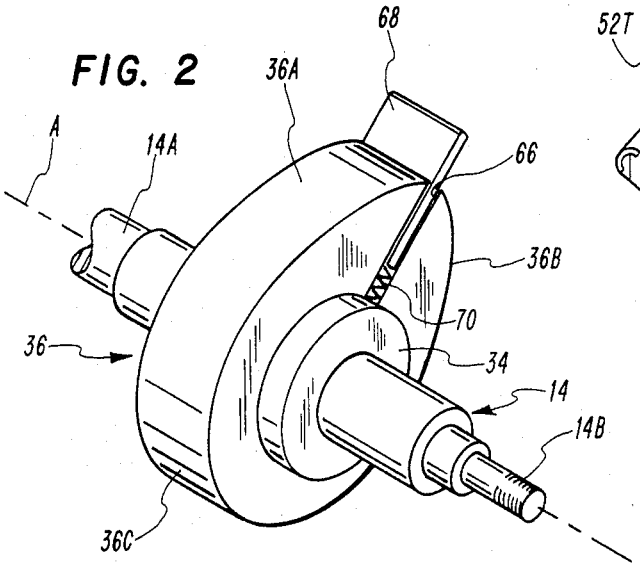
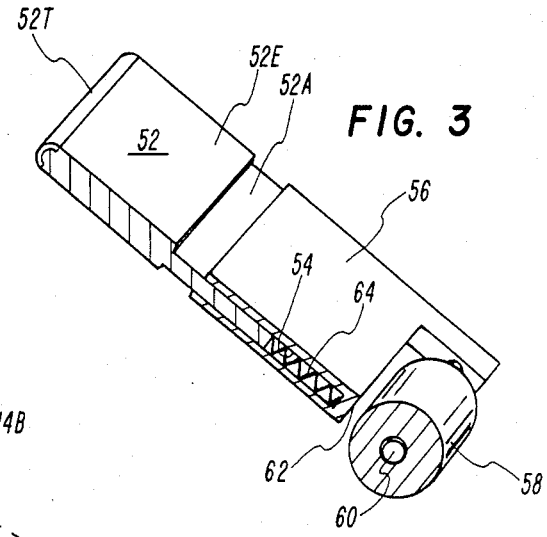
FIG. 3

ROTARY PISTON ENGINE

FIELD OF THE INVENTION

The present invention relates generally to internal combustion engines, and in particular to internal combustion engines having a rotary piston.

BACKGROUND OF THE INVENTION

The rotary piston engine is an internal combustion engine which operates on the same general principal as a reciprocating piston internal combustion engine. In a conventional internal combustion engine, a reciprocating piston is coupled to a connecting rod for producing rotation and torque. In a rotary piston engine, torque is produced by means of a rotating piston which avoids the necessity for alternately accelerating and retarding a large mass as occurs when an ordinary piston moves to and fro. Consequently, the forces of inertia associated with the reversing stroke movement of a conventional reciprocal piston engine are avoided. As a result, higher speeds of rotation are possible in a rotary piston engine, and stresses which are imposed by the reversing stroke movement are avoided.

Another limitation of conventional internal combustion engines in general is their inability to provide high torque at low speed and relatively constant torque over a wide range of speed.

DESCRIPTION OF THE PRIOR ART

A variety of internal combustion rotary piston engines have been developed in an attempt to provide improved performance with respect to the conventional reciprocating piston internal combustion engine.

The Wankel engine is a well known example of a rotary piston engine. In the Wankel engine, a triangular piston having convex sides rotates within an oval chamber. When the piston rotates, the sealing elements mounted at its three corners continuously sweep along the wall of the chamber. The three enclosed spaces formed between the piston and the chamber wall successively increase and decrease in size with each revolution. These variations in the spaces are utilized for drawing in the fuel and air mixture, for compressing the mixture, for combustion, and for discharging the combustion gases, so that the full four-stroke working cycle is performed. In the first stroke (induction) of the cycle, the rotary piston uncovers an inlet port, thereby admitting a mixture of fuel and air. In the second stroke (compression), the fuel and air mixture is compressed. In the third stroke (ignition and power expansion), the compressed mixture is ignited by a spark plug, and the expanding combustion gases drive the piston. In the fourth stroke (exhaust), the combustion gases are discharged through an outlet port.

One obstacle in the construction of a rotary piston engine of the Wankel type is the sealing of the three chambers in relation to one another. Leakage between these chambers is detrimental to engine performance. Moreover, some conventional rotary engines have adopted the traditional four-cycle method of compressing a combustible fuel mixture in the same chamber where combustion and expansion occurs. This type of arrangement leads to incomplete combustion and a high level of noxious pollutants. An additional limitation of engines of the Wankel type is a relatively short power stroke resulting in poor fuel economy and increased HC and CU emissions.

There remains considerable interest in improving the performance of rotary piston engines.

SUMMARY OF THE INVENTION

In accordance with the present invention, an improved rotary piston engine having a pear-shaped piston with convex sides is mounted for rotation within a housing whose internal cross section presents a symmetrical oval shape which is slightly constricted in the middle. The annular chamber between the piston and the housing is subdivided into intake, compression, expansion and exhaust chambers by four spring loaded vanes, three of which slide along the surface of the piston, and one against the housing bore. A counter-piston vane bears against the piston and separates the intake and compression chambers with respect to the expansion and exhaust chambers. A vane carried by the piston bears against the surface of the housing bore and subdivides each chamber in turn as the piston rotates. The piston vane is spring loaded so that the effective length of the piston varies according to the radius of the curved chamber sidewall as the piston turns.

A compression vane and the counter-piston vane are disposed on opposite sides of an external combustion chamber formed in a housing portion which constricts the annular chamber. Extension and retraction movement of the compression vane and the counter-piston vane is coordinated to seal the combustion chamber with respect to the exhaust chamber and the intake chamber during compression and combustion. An engine separation vane, mounted for reciprocal movement and sliding engagement against the piston, separates the intake and exhaust chambers.

Because the thrust which is developed is applied perpendicular to the rotary piston radius, maximum torque is derived from the power produced by the combustion.

According to an important aspect of the preferred embodiment, combustion of the compressed fuel/air mixture is accomplished while the external combustion chamber is isolated from the intake and expansion chambers. As a result, fuel pollutants in the exhaust are reduced because the fuel/air mixture is substantially burned in the combustion chamber before being expanded and cooled.

The novel features which characterize the present invention are defined by the appended claims. The foregoing and other objects and advantages of the present invention will hereinafter appear, and for purposes of illustration, but not of limitation, an exemplary embodiment is shown in the drawings.

BRIEF DESCRIPTION OF THE DRAWINGS

FIG. 1 is a sectional view, partly in elevation, of the rotary piston engine constructed according to the teachings of the present invention.

FIG. 2 is a perspective view of a rotary piston taken from the engine shown in FIG. 1;

FIG. 3 is a simplified perspective view, partly in section, of a counter-piston vane taken from the engine shown in FIG. 1;

DETAILED DESCRIPTION OF THE PREFERRED EMBODIMENT

Figure 4:
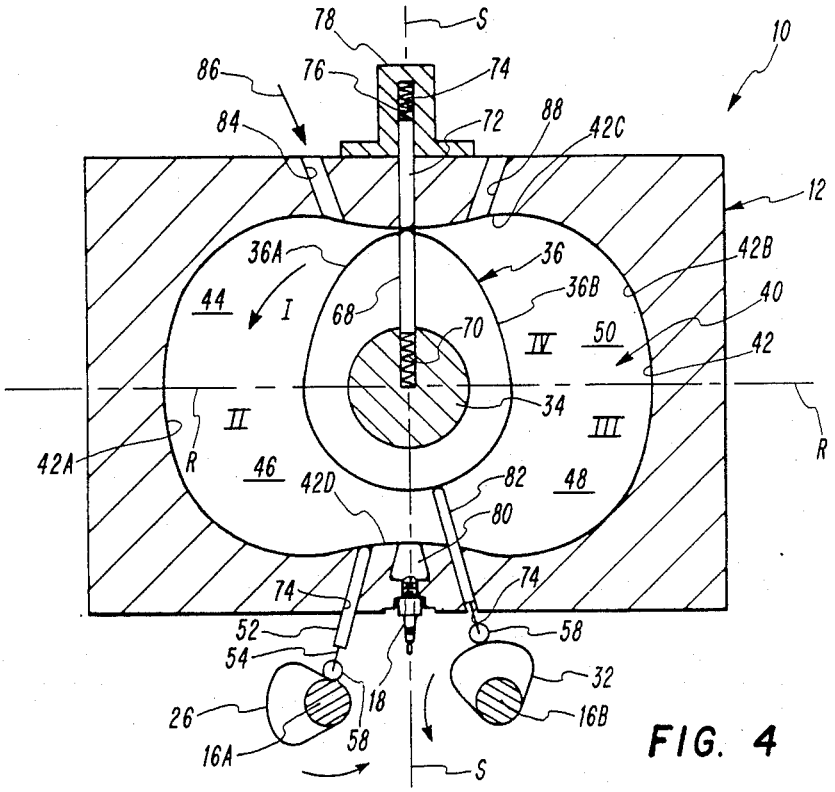
FIG. 4 is a simplified sectional view of a rotary piston engine which corresponds generally with the engine of FIG. 1.

In the description which follows, like parts are marked throughout the specification and drawings with the same reference numerals, respectively. The drawings are not necessarily to scale and in some instances, proportions have been exaggerated in order to more clearly depict certain features of the invention.

Referring now to FIG. 1, a rotary engine 10 has an engine casing 12. A power shaft 14 runs through the center of the engine casing 12, and extends beyond both ends. One end 14A is connectable to a torque converter (not shown) and the other end 14B is adapted for power takeoff to other apparatus as desired, including timing shafts 16A, 16B. The speed of rotation of the timing shafts 16A, 16B is a function of the rotational speed of the power shaft 14, and is used for timing an ignition system (not shown) for delivering an electrical ignition pulse P to a spark plug 18.

The timing shafts 16A, 16B are driven by a timing chain 20. The timing chain 20 engages a sprocket 22 which is attached to timing shaft 16A, and a sprocket 24 which is attached to the power shaft 14. Movement of the timing chain 20 causes rotation of the timing shaft 16A and rotation of a cam 26. An auxiliary timing chain 28 is coupled to a sprocket 30 which is also attached to the timing shaft 16A. The auxiliary timing chain 28 drives the second timing shaft 16B to which a second cam 32 is attached.

Referring now to FIGS. 1 and 2, a rotor 34 is rigidly secured to the power shaft 14. A perspective view of the rotor 34 is shown in FIG. 2. The rotor 34 and the drive shaft 14 form an integral assembly. A rotary piston 36 is rigidly secured to the rotor 34 and power shaft 14. The power shaft and piston are mounted for rotation on ball bearing assembly 38, with the piston being received for rotation within a chamber 40.

The engine 10 includes a main housing H and opposed end covers 11, 13. The ball bearing assemblies 38 are mounted within the main housing, with the end cover 11 serving as a seal through which the power shaft 14A extends for transmitting output torque. The opposite end cover 13 provides a seal through which power shaft 14B extends, which encloses and protects the timing chain 20 and timing sprockets 22, 24.

The rotor 34 and power shaft 14 are mounted within the bore 42 for rotation about an axis A which is concentric with the central axis of the bore 42 as defined by the intersection of the principal lines of symmetry R, S of the constricted housing chamber 40.

According to an important aspect of the present invention, the piston 36 is pear-shaped in profile with convex side surfaces 36A, 36B and 36C. The convex side surface 36C is generally cylindrical, and transitions symmetrically along parabolic curves on opposite sides to form convex side surfaces 36A, 36B. The piston 36 is mounted for rotation within the housing block 12 whose internal bore 42 presents a symmetrical oval shape relative to lines of symmetry R, S and is slightly constricted about its middle.

Referring to FIG. 4, in the preferred embodiment, the internal bore 42 of housing block 12 is defined by the union of convex and concave bore surfaces. In particular, opposite convex surfaces 42A, 42B are symmetrical with respect to symmetry line R, and transition smoothly through convex bore surfaces 42C, 42D. Convex surfaces 42C, 42D are symmetrical with respect to symmetry line S. As can best be seen in FIG. 4, the radius of the piston 36 at the union of convex surfaces 36A, 36B is just slightly smaller than the constricted bore diameter at convex surface 42C.

The annular chamber 40 between the piston 36 and housing bore 42 comprises generally quadrant regions I (intake chamber 44), quadrant region II (compression chamber 46), quadrant region III (expansion chamber 48) and quadrant region IV (exhaust chamber 50). The annular chamber 40 is subdivided at various locations by combinations of four spring loaded vanes, three of which engage and slide along the convex surfaces 36A, 36B and 36C of the piston, and one which engages and slides along the housing bore 42. A counter-piston vane 52 bears against the convex side surfaces of the piston 36, thereby isolating the intake chamber 44 and compression chamber 46 with respect to the expansion chamber 48 and exhaust chamber 50.

A preferred embodiment of the counter-piston vane 52 is illustrated in FIG. 3. According to this arrangement, the vane 52 has a base portion 52A received in slideable, telescoping engagement in a pocket 54 formed within a yoke 56. A trundle 58 is mounted for rotation on an axle 60. The axle 60 and trundle 58 are supported within a slot 62 formed within the lower end of yoke 56. The trundle 58 engages the cam 26 in rolling engagement.

The vane 52 is provided with a tip portion 52T made of a wear resistant material such as silicon carbide coated graphite/epoxy composite. The tip 52T slides against the curved side surfaces of the piston 36 and forms an effective viscous seal. Engagement of the vane 52 against the piston 36 is biased by a compression spring 64 which is confined within the pocket 54 between the vane base portion 52A and yoke 56. According to this arrangement, positive contact between the vane and piston is maintained as the vane tip 52T traverses the curved piston side surfaces 36A, 36B and 36C.

Referring again to FIG. 2, the piston 36 has a radially extending slot 66 in which a vane 68 is slideably received for extension and retraction. The vane 68 is biased for yieldable, thrusting engagement against the concave and convex housing bore surfaces 42A, 42B, 42C and 42D by a compression spring 70. A viscous seal is provided along the line of engagement between the vane 68 and the curved housing bore 42 as piston vane 68 sweeps through each quadrant.

An engine separation vane 72 is slideably received within a slot 74 formed in the engine block 12 in alignment with the symmetrical axis S. The engine separation vane 72 is biased for yieldable, thrusting engagement against the convex curved side surfaces of the piston 36 by a compression spring 76. The compression spring 76 is confined within a retainer housing 78 which is mounted onto the engine block 12. The engine separation vane 72 is extended and retracted along slot 74 as it bears against piston 36, thereby separating the intake chamber 44 with respect to the exhaust chamber 50.

According to an important feature of the invention, ignition of the compressed fuel/air mixture is initiated within an external combustion chamber 80 formed within the engine block 12. The chamber 80 is characterized as "external" in the sense that it does not form a part of the annular chamber 40, but is in open communication with the annular chamber 40 at the interface between the compression chamber 46 and the expansion chamber 48. In the preferred embodiment, the external combustion chamber 80 is aligned with the vertical axis S of symmetry, which is the nominal boundary between the compression chamber 46 and the expansion chamber 48.

According to an important aspect of the preferred embodiment, the external combustion chamber 80 is isolated with respect to the compression chamber 46 and expansion chamber 48 by the counter-piston vane 52 and by a compression vane 82. Both vanes 52, 82 are mounted for extension and retraction through slots 74 which extend transversely through the engine block 12 on opposite sides of the external combustion chamber 80. According to this arrangement, ignition and combustion of the compressed fuel/air mixture is substantially completed while the external combustion chamber is isolated with respect to the intake and expansion chambers. As a result, fuel pollutants in the exhaust are reduced because the fuel/air mixture is substantially burned before being expanded and cooled.

Extension and retraction movement of the counter-piston vane 52 and compression vane 82 is coordinated by rotation of the cams 26, 32.

The engine housing block 12 is also provided with an intake passage 84 which communicates with the inlet chamber 44 for admitting a fuel/air mixture 86. The engine block 12 is also provided with an exhaust passage 88 communicating with the exhaust chamber 50 through which combustion products 90 are discharged.

It will be appreciated that operational efficiency will be improved by good viscous sealing between the side surfaces of the vanes and the engine block 12. For this purpose, guide channels 92A, 92B are formed in the block in alignment with the slots 74, and each vane has opposite side edge portions (for example, 52E) which are slidably received within the guide channels. The vanes are freely movable through the slots and channels. The vane/guide channel interface prevents circumferential deflection and also provides a baffle effect which enhances the viscous seal.

Operation of the rotary engine 10 is described with reference to FIGS. 4–13. During the induction portion of the cycle, the rotary piston 36 uncovers the inlet passage 84, thereby admitting a combustible fuel/air mixture 86 into the intake chamber 44. As the piston 36 sweep through the annular chamber 40, the piston vane 68 defines a moving boundary between the intake chamber 44 and the compression chamber 46. The piston vane 68 automatically extends and retracts radially through the slot 66 as it engages the curved sidewall of the housing bore 42. During the intake portion of the cycle, the counter-piston vane 52 is retracted out of the compression chamber 46, and the compression vane 82 rides in sliding engagement against the curved surface of the piston 36.

Figure 5:
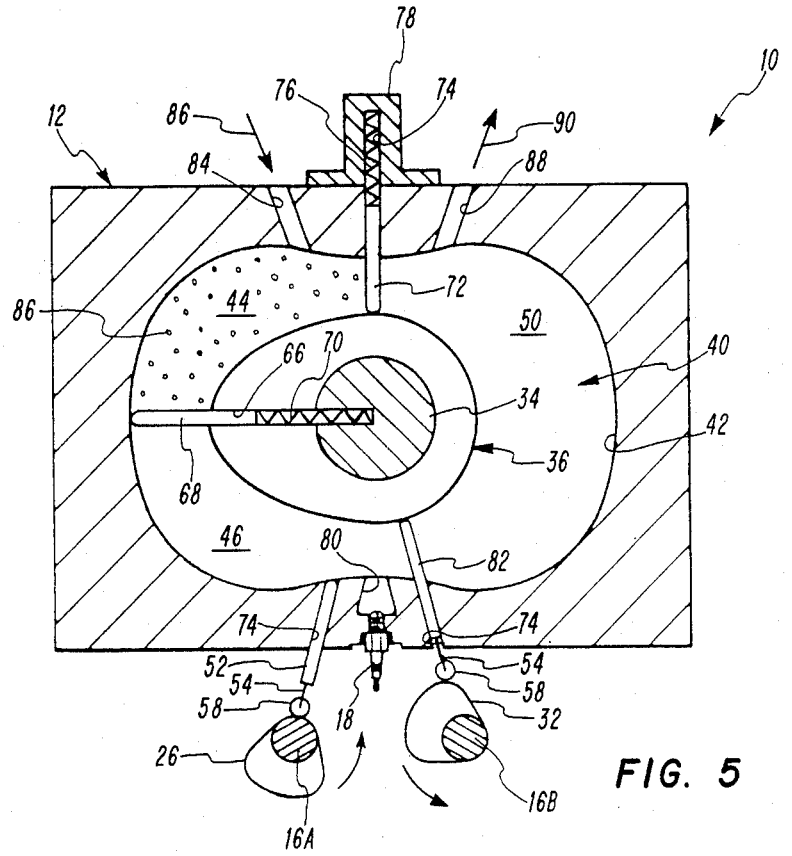
FIGS. 5, 6 and 7 are views similar to FIG. 4 which illustrate induction of fuel/air mixture.

Because both the piston vane 68 and the compression vane 82 are yieldably biased by compression springs, a viscous seal is constantly maintained along the lines of sliding engagement. During the first quarter stroke as shown in FIG. 5, the engine separation vane 72 seals the intake chamber 44 with respect to the exhaust chamber 50, while the piston vane 68 seals the intake chamber 44 with respect to the combustion chamber 46, and the counter-piston vane 82 seals the compression chamber 46 with respect to the expansion chamber 48.

Figure 6:
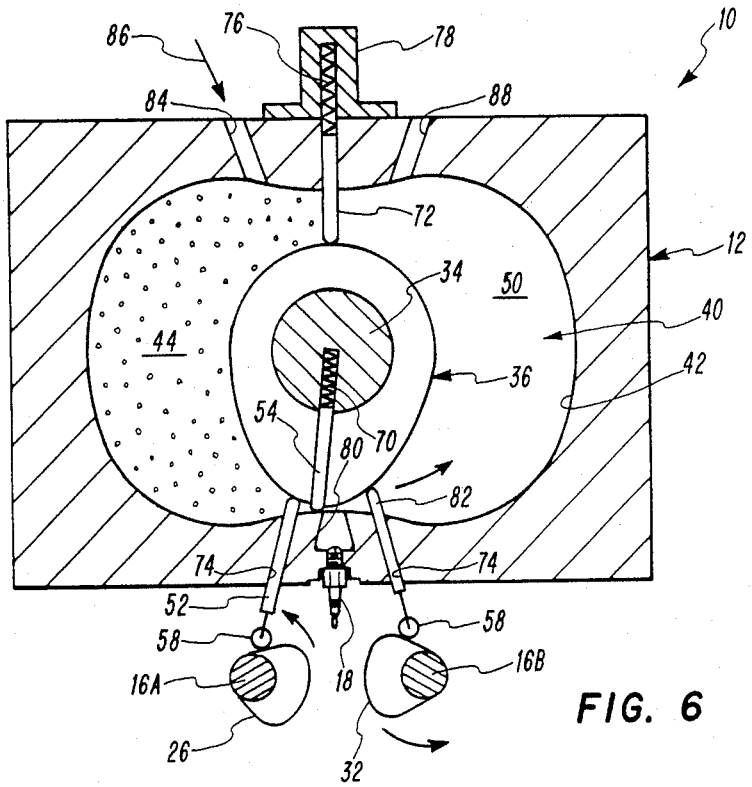

As the piston 36 nears the limit of the intake stroke, the volume of the intake chamber 44 is maximized and the volume of the compression chamber 46 is minimized as indicated in FIG. 6. The engine separation vane 72 continues to bear against the piston 36, thereby separating the intake chamber 44 with respect to the exhaust chamber 50.

Figure 7:
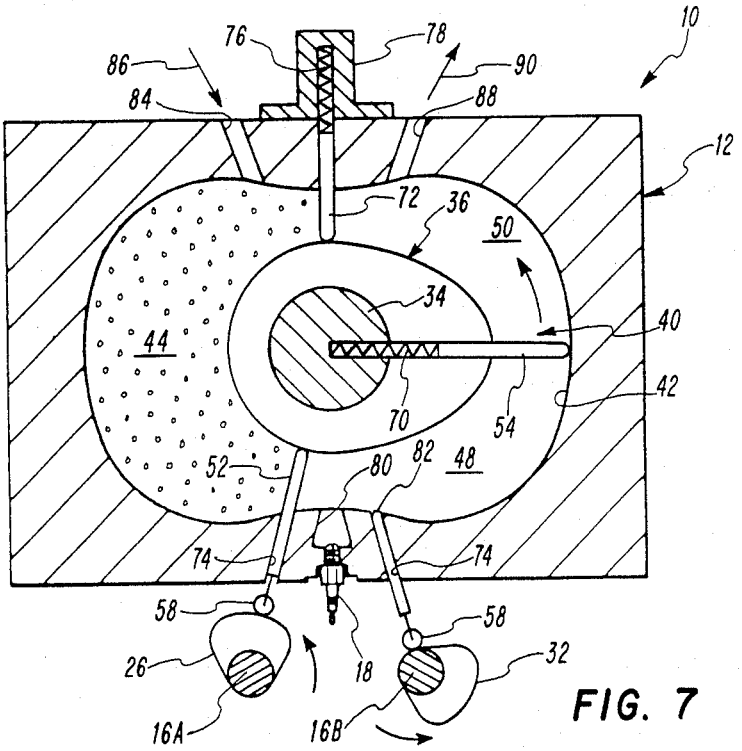

As the piston 36 continues sweeping through the annular chamber 40, it defines a moving boundary between the expansion chamber 48 and the combustion chamber 50 as indicated in FIG. 7. As the piston sweeps from the 6:00 o'clock position toward the 12:00 o'clock position, the counter-piston vane 52 is extended by cam 26 for continuous engagement against the curved cylindrical piston surface 36C. At the same time, the compression vane 82 is retracted through slot 74 to allow clearance for turning movement of piston 36 and piston vane 54 as indicated in FIG. 7.

Figure 8:
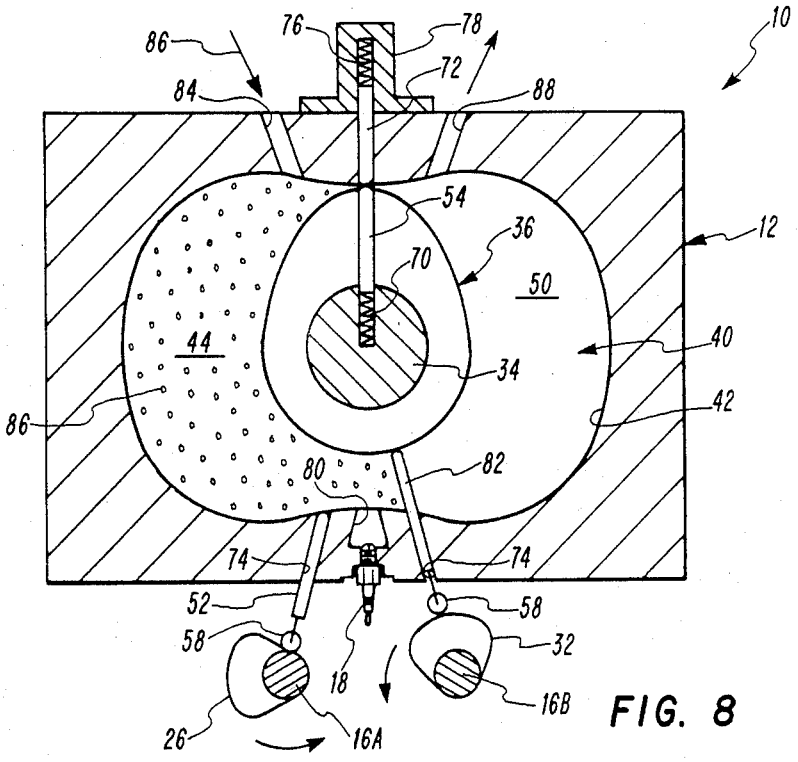
FIGS. 8, and 9 are sectional views similar to FIG. 4 which illustrate compression of the fuel/air mixture.
Figure 9:
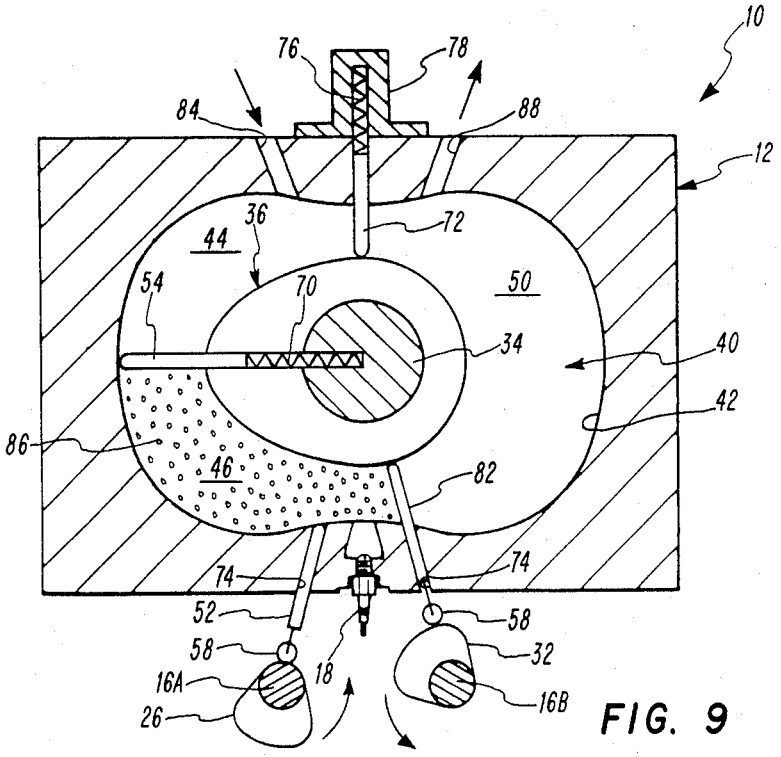
Figure 10:
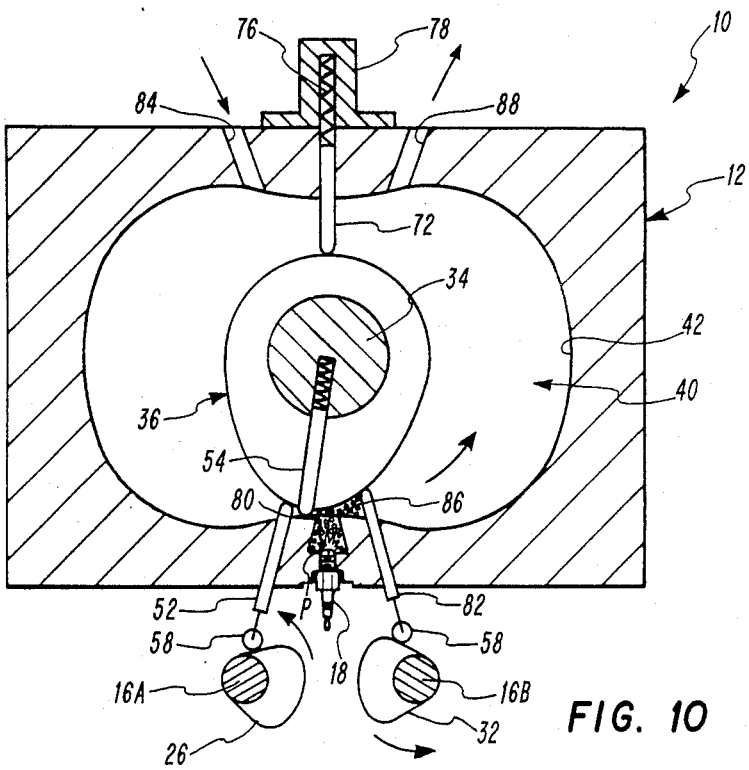
FIG. 10 is a sectional view similar to FIG. 9 which illustrates ignition of the compressed fuel/air mixture.

The onset of compression of the fuel/air mixture 86 is indicated in FIG. 8. In FIG. 8, the intake chamber 44 is merged with the compression chamber 46, with the volume of the intake chamber gradually increasing, and the volume of the compression chamber gradually decreasing as piston 36 and piston vane 54 sweep through the annulus 40 as illustrated in FIG. 9. As the piston 36 nears the limit of the compression stroke, the counter-piston vane 52 is extended into engagement with the piston 36 while the compression vane 82 engages the piston 36 on the opposite side of the external combustion chamber 80. As indicated in FIG. 10, as the piston 36 and piston vane 54 approach dead center alignment with the external combustion chamber 80, electrical current is applied to the spark plug 18, thereby producing a pulse spark discharge P and igniting the fuel/air mixture 86 within the enclosed external combustion chamber 80.

Figure 11:
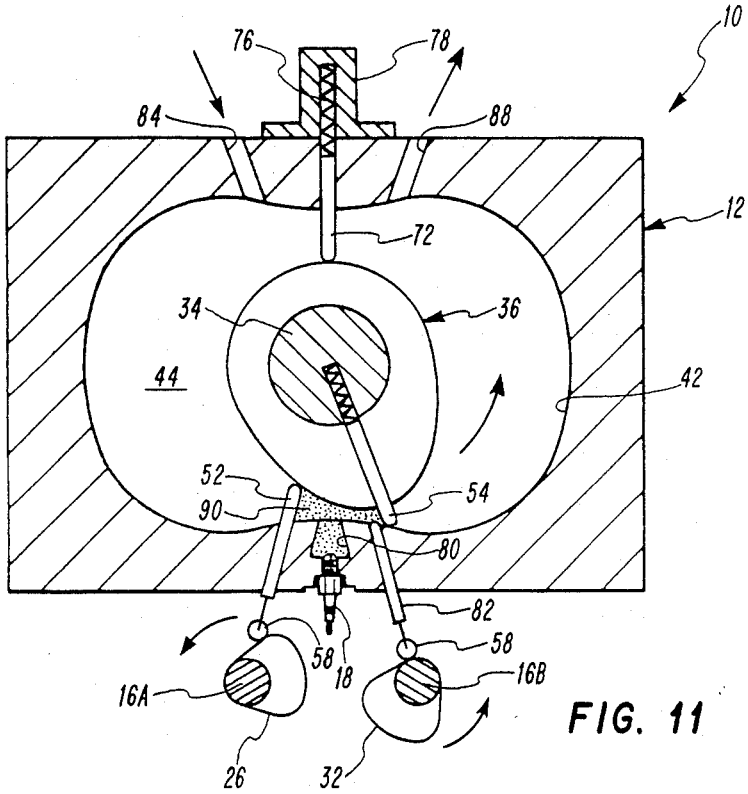
FIG. 11 is a view similar to FIG. 10 which illustrates initial expansion of combustion gases in a power stroke.
Figure 12:
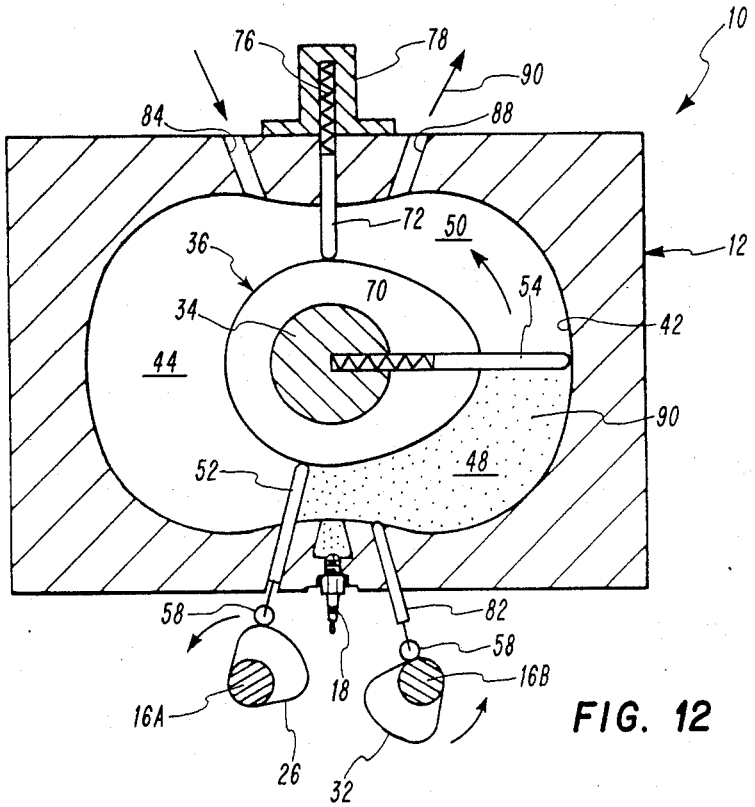
FIG. 12 is a view similar to FIG. 11 which illustrates an intermediate power stroke position; and, FIG. 13 is a view similar to FIG. 12 which illustrates completion of the power stroke.
Figure 13:
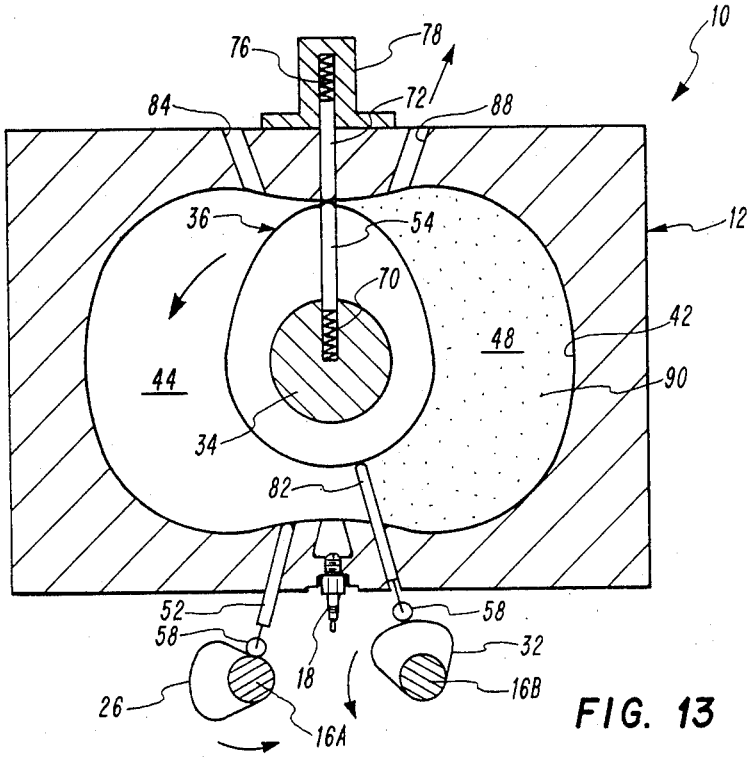

The power stroke portion of the cycle is initiated, as shown in FIG. 11, as the expanding products of combustion 90 apply a turning force against the piston 36 and piston vane 54. The counter-piston vane 52 seals the intake chamber 44 with respect to the expansion chamber 48 as the power stroke is developed, as indicated in FIG. 12. At the limit of the power stroke as shown in FIG. 13, the expansion chamber 48 reaches its maximum volume as the exhaust chamber 50 is reduced to its minimum volume. In the 12:00 o'clock position of the piston 36 as shown in FIG. 13, the power stroke is complete and the piston is in position for onset of the next intake of fuel/air mixture.

It will be understood, upon review of FIGS. 4-13, that intake and compression are performed simultaneously as the piston sweeps through chamber quadrants I, II, and that expansion and compression are performed simultaneously as the piston and piston vane sweep through chamber quadrants III, IV. Consequently, the engine 10 will develop one complete power stroke per revolution, whereas the conventional reciprocating piston engine develops a power stroke only every other revolution. Because of this, the rotary engine 10 will develop more horsepower per piston displacement as compared with a comparable conventional reciprocating piston engine.

In a reciprocating piston engine, when the piston reaches bottom dead center, it immediately reverses its direction of movement and thereby diminishes the displacement volume. At that point, the intake stroke is over. Because of the shortness of the intake duration, the volumetric efficiency is substantially reduced, particularly at high rpm. Moreover, the maximum displacement volume occurs for a relatively short period of time with the result that there is not enough time for the cylinder to be filled completely with the fuel/air mixture. Consequently, low volumetric efficiency is experienced. In the present invention, however, the inlet passage 84 is always open to admit the fuel/air mixture and the period of maximum piston displacement is the full intake sweep through chamber quadrants I and II plus an additional 150° or more through quadrants III and IV. Consequently, once the engine has achieved 100% volumetric efficiency, because of the high speed of the intake air flow, additional ram pressure is achieved thereby increasing volumetric efficiency to a level of about 110%. In contrast, conventional reciprocating piston engines have a volumetric efficiency of only about 75% at maximum rated horsepower.

Conventional reciprocating piston engines also are limited in power output by a back pressure condition in which the piston must work against back pressure caused by residual exhaust gases in the cylinder which are present as the piston begins its reversal of movement on the exhaust stroke. In the rotary engine of the present invention, on the other hand, the exhaust passage 88 remains open as the piston sweeps through the intake/compression quadrants I, II, thereby giving sufficient time for the excess exhaust pressure to be relieved through the exhaust passage. According to this arrangement, back pressure is substantially reduced.

In the foregoing preferred embodiment, the geometry of the rotor chamber is symmetrical, with the chamber quadrants having substantially equal volumes. However, the geometry of the rotor chamber 40 can be adjusted so that the combined volume of quadrants III and IV associated with expansion and exhaust can be made to be larger than the volume on the intake and compression quadrants I, II. For example, an unequal volume is provided by locating the intake port, the exhaust port and the engine separation vane 72 in a location skewed toward the intake side by about 20°-25°. This will provide an increase in the volume of the power stroke side of the engine of about 30%. The advantages of having the piston chamber 40 divided into unequal volumes are greater fuel economy, increased volumetric efficiency, lower exhaust emissions which will permit higher fuel/air mixture ratios, and increased compression ratios.

An additional advantage of the foregoing rotary engine arrangement is that the engine block 12 adjoining the intake chamber 44 and compression chamber 46 can be separately cooled with respect to the portion of the engine block enclosing the expansion chamber 48 and exhaust chamber 50. That is, coolant from a radiator or other heat exchanger can be circulated first through the manifold M (FIG. 1) adjoining intake chamber quadrant I and compression chamber quadrant II, and thereafter can be circulated, through the exhaust manifold E adjoining the expansion chamber quadrant III and exhaust chamber quadrant IV. By this arrangement, the intake and compression chambers 44, 46 can be maintained at a substantially lower temperature level relative to the expansion chamber 48 and exhaust chamber 50. This increases the compression ratio, reduces engine heat losses, and lowers the amount of unburned fuel and pollutants in the exhaust emissions.

It will be noted that the spark plug 18 is mounted in the exact center of the combustion chamber defined by the counter-piston vane 52, the compression vane 82, and the external combustion chamber 80. By establishing a central location of the spark plug with respect to the effective combustion chamber, a faster burn rate is achieved, thereby permitting a reduction in the spark advance and an increase in the compression ratio.

Although the invention has been described with reference to a specific embodiment, the foregoing description is not intended to be construed in a limiting sense. Various modifications to the disclosed embodiment as well as alternative applications of the invention will be suggested to persons skilled in the art by the foregoing specification and illustrations. It is therefore contemplated that the appended claims will cover any such modifications, applications or embodiments as fall within the true scope of the invention.

What is claimed is:

1. An improved rotary piston engine comprising, in combination:

a housing having an internal chamber bounded by curved bore including convex and concave curved surfaces, the internal cross section of the chamber presenting an oval profile which is constricted about a housing section disposed intermediate said convex and curved surfaces;

a piston mounted for rotation within said chamber, said piston having a convex curved external surface and a slot intersecting said convex surface for receiving a movable vane;

a piston vane mounted for extension and retraction through said piston slot;

a resilient member mounted in said piston slot biasing said piston vane into yieldable engagement with said housing bore;

a counter-piston vane mounted on said housing for extension into and retraction out of said housing chamber, said counter-piston vane being mounted for sliding movement within a slot which intersects said housing through said constricted housing section;

a compression vane mounted for extension and retraction into and out of said housing chamber, said compression vane being received within a slot which intersects said constricted housing section;

said housing having a combustion chamber disposed within said constricted housing section intermediate said counter-piston vane and said compression vane, said combustion chamber being in fluid communication with said housing chamber, and said housing having intake and exhaust ports intersecting said housing in fluid communication with said internal chamber;

an engine separation vane mounted for extension and retraction into and out of said housing chamber, said engine separation vane being received for sliding movement within a slot intersecting said housing intermediate said intake and exhaust ports; and, resilient means coupled to said engine separation vane for biasing said engine separation vane into yieldable engagement against the convex curved surface of said piston.

2. An improved rotary piston engine as defined in claim 1, said oval profile being defined by first and second oppositely disposed concave bore surfaces and first and second oppositely disposed convex bore surfaces.

3. An improved rotary piston engine as defined in claim 2, said chamber being symmetrical about first and second axis lines, said concave bore surfaces being symmetrical with respect to one of said lines of symmetry, and said convex bore surfaces being symmetrical with respect to said other line of symmetry.

4. An improved rotary piston engine as defined in claim 1, said constricted housing section being bounded by a convex bore surface which transitions smoothly between first and second concave bore surfaces.

5. An improved rotary piston engine as defined in claim 1, including means coupled to said compression vane and said counter-piston vane for coordinating extension and retraction of said compression vane and counter-piston vane for engagement and disengagement with said piston.

6. An improved rotary engine as defined in claim 1, said piston being pear-shaped in profile with said convex side surface comprising a first half cylinder section and first and second convex surfaces which transition symmetrically along parabolic curves on opposite sides of a longitudinal axis, said piston vane being positioned for extension and retraction along the longitudinal axis of said piston.

7. A rotary piston engine comprising a housing having an interior chamber whose cross section presents a symmetrical oval shape which is constricted about its mid-section; a pear-shaped piston with convex sides mounted for rotation within said housing chamber; the annulus between the piston and the housing being subdivided into intake, compression, expansion and exhaust chamber regions; n external combustion chamber formed in said housing and intersecting said constricted section of said housing; a compression vane and a counter-piston vane being mounted on opposite sides of the external combustion chamber for extension and retraction into and out of the annulus between the piston and the housing bore; means for coordinating extension and retraction of said compression vane and counter-piston vane for engagement and disengagement with said piston for sealing the combustion chamber with respect to the exhaust chamber and the intake chamber during compression and combustion strokes; an engine separation vane mounted for reciprocal movement and sliding engagement against the piston thereby separating the intake and exhaust chamber regions; and, a piston vane mounted on said piston for bearing against the housing bore and subdividing each chamber in turn as the piston rotates.

* * * * *

UNITED STATES PATENT AND TRADEMARK OFFICE

CERTIFICATE OF CORRECTION

PATENT NO. : 4,817,567

DATED : April 4, 1989

INVENTOR(S) : Ronald C. Wilks

It is certified that error appears in the above-identified patent and that said Letters Patent is hereby corrected as shown below:

Column 5, line 56, "sweep" should be -- sweeps --.

Column 10, line 10, "n" should be -- an --.

Signed and Sealed this

Seventeenth Day of October, 1989

*Attest:*

DONALD J. QUIGG

*Attesting Officer*

*Commissioner of Patents and Trademarks*